US012275569B2

(12) United States Patent
Tanaka et al.

(10) Patent No.: US 12,275,569 B2
(45) Date of Patent: Apr. 15, 2025

(54) SPOUTED POUCH

(71) Applicant: Toyo Seikan Co., Ltd., Tokyo (JP)

(72) Inventors: Hiroki Tanaka, Yokohama (JP); Motohide Hata, Yokohama (JP)

(73) Assignee: TOYO SEIKAN CO., LTD., Tokyo (JP)

( * ) Notice: Subject to any disclaimer, the term of this patent is extended or adjusted under 35 U.S.C. 154(b) by 0 days.

(21) Appl. No.: 18/100,950

(22) Filed: Jan. 24, 2023

(65) Prior Publication Data

US 2023/0159248 A1 May 25, 2023

Related U.S. Application Data

(63) Continuation of application No. PCT/JP2021/016716, filed on Apr. 27, 2021.

(30) Foreign Application Priority Data

Jul. 28, 2020 (JP) ..... 2020-127111

(51) Int. Cl.
*B65D 75/00* (2006.01)
*B65D 75/56* (2006.01)
*B65D 75/58* (2006.01)

(52) U.S. Cl.
CPC ..... *B65D 75/008* (2013.01); *B65D 75/566* (2013.01); *B65D 75/5877* (2013.01); *B65D 2575/30* (2013.01)

(58) Field of Classification Search
CPC . B65D 75/008; B65D 75/566; B65D 75/5877
(Continued)

(56) References Cited

U.S. PATENT DOCUMENTS 3,206,105 A * 9/1965 Smith ..... B65D 37/00 383/906
3,434,652 A * 3/1969 Shore ..... B65D 75/52 383/122

(Continued)

FOREIGN PATENT DOCUMENTS

JP 60-13370 U1 1/1985
JP 6-179455 A 6/1994

(Continued)

OTHER PUBLICATIONS

International Search Report dated Jul. 20, 2021, issued in counterpart International Application No. PCT/JP2021/016716. (2 pages).

*Primary Examiner* — Peter N Helvey
(74) *Attorney, Agent, or Firm* — WHDA, LLP

(57) ABSTRACT

To provide a spouted pouch with a simple structure and improved self-standing ability of the pouch body. The spouted pouch 10 is configured to dispense a liquid content from a spout 60 attached to a side face of a pouch body 20 in a state placed with a pouch bottom 20*a* down. The pouch body 20 further includes a first shape-controlling seal portion 24 formed by heat sealing a first film 30 and a side film 40 together at a location on an inner side of a first side seal 23*a* in the left-right direction. The first shape-controlling seal portion 24 has an area located in a region between an upper half of a spout fixture portion 32 and the first side seals 23*a*, and does not have an area located below the center in the up-down direction of the spout fixture portion 32.

5 Claims, 4 Drawing Sheets

(58) Field of Classification Search
USPC ..... 383/104
See application file for complete search history.

(56) References Cited

U.S. PATENT DOCUMENTS

| | | | | |
|---|---|---|---|---|
| 4,904,093 | A * | 2/1990 | Woods | B65D 31/02 383/122 |
| 6,966,697 | B2 * | 11/2005 | Patridge | B65D 33/1608 220/495.11 |
| 2002/0148857 | A1 * | 10/2002 | Savage | B65D 75/5877 222/107 |
| 2005/0084568 | A1 * | 4/2005 | Matsumoto | B65D 81/3897 426/106 |
| 2005/0238264 | A1 * | 10/2005 | Ikeda | B65D 75/008 383/906 |
| 2014/0246455 | A1 * | 9/2014 | Murray | B67D 3/0067 222/107 |
| 2015/0125097 | A1 * | 5/2015 | Kenmotsu | B65D 31/10 383/42 |
| 2015/0274392 | A1 * | 10/2015 | Pease | B65D 75/48 493/243 |

FOREIGN PATENT DOCUMENTS

| | | | |
|---|---|---|---|
| JP | 2012-121611 | A | 6/2012 |
| JP | 1557226 | S | 8/2016 |
| JP | 2018-165167 | A | 10/2018 |

* cited by examiner

SPOUTED POUCH

TECHNICAL FIELD

The present invention relates to a spouted pouch configured to dispense a liquid content from a spout attached to a side face of the pouch body in a state placed with the pouch bottom down.

BACKGROUND ART

Spouted pouches with a spout as an outlet port attached to the pouch body made up of a plurality of heat-sealed resin films are conventionally known (see, for example, Patent Literature 1) to be used as a container that contains liquid contents such as drinking water or liquid detergent.

Such a spouted pouch is known to be used in a manner in which the liquid content is dispensed from the spout attached to a side face of the pouch body in a state placed with the pouch bottom down as shown in FIG. 6.

CITATION LIST

Patent Literature

[Patent Literature 1] Japanese Patent Application Publication No. 2012-121611

SUMMARY OF INVENTION

Technical Problem

One issue, however, is that, because the resin films that make up the pouch body are flexible, sometimes a phenomenon called bulging can occur in lower parts of the pouch body 120 where each of the films 130, 140, and 150 expands outward by the weight of the liquid content as shown in lateral views of the pouch in the lower left and lower right diagrams of FIG. 6, particularly in the case where the pouch body is formed as a large size pouch such as size 6L. Such bulging sometimes results in formation of buckle-triggering points P where the films 130, 140, and 150 flex inward and are dented as shown in the lower center diagram of FIG. 6, near lower parts of each of side seals 123*a* and 123*b*.

Once such buckle-triggering points P are formed, the pouch body 120 tends to easily buckle at these buckle-triggering points P, which compromises the self-standing ability of the spouted pouch.

Accordingly, it is an object of the present invention to solve these problems, and to provide a spouted pouch with a simple structure and improved self-standing ability of the pouch body.

Solution to Problem

The present invention solves the above problem by providing a spouted pouch configured to dispense a liquid content from a spout attached to a side face of a pouch body in a state placed with a pouch bottom down, the pouch body including a first film having a spout fixture portion to which a spout fixture target portion of the spout is fixed, and side films connected to the first film via first side seals formed on both left and right sides of the first film, the pouch body further including a first shape-controlling seal portion formed by heat sealing the first film and the side film together at a location on an inner side of the first side seal in a left-right direction, the first shape-controlling seal portion having an area located in a region between an upper half of the spout fixture portion and the first side seals, and not having an area located below a center in an up-down direction of the spout fixture portion.

Advantageous Effects of Invention

According to the invention set forth in claim 1, the pouch body further includes a first shape-controlling seal portion formed by heat sealing the first film and the side film together at a location on an inner side of the first side seal in a left-right direction. The first shape-controlling seal portion has an area located in a region between an upper half of the spout fixture portion and the first side seals, and does not have an area located below the center in the up-down direction of the spout fixture portion. This allows for adjustment of the inclination of the spout fixture target portion, and this adjustment of the inclination of the spout fixture target portion can be used to minimize creation of buckle-triggering points, which tend to form near lower parts of the first side seals.

Namely, according to the invention set forth in claim 1, the vicinity of the first shape-controlling seal portion of the first film is dented or caved inward of the pouch from the surrounding area. In reaction to this, the vicinity of the area below the first shape-controlling seal of the first film protrudes or bulges outward of the pouch. Utilizing this outward bulge, it is possible to adjust the inclination of the spout fixture target portion such as to shift the upper side of the spout fixture target portion inward of the pouch and to shift the lower side of the spout fixture target portion outward of the pouch. The adjustment of the inclination of the spout fixture target portion described above is utilized this way to minimize creation of buckle-triggering points, which tend to form near lower parts of the first side seals. Thus the self-standing ability of the spouted pouch can be improved.

According to the invention set forth in claim 3, the first shape-controlling seal portion is formed on both left and right sides of the spout fixture target portion. The inclination of the spout fixture target portion can thus be adjusted from both left and right sides in a reliable manner, so that creation of buckle-triggering points that tend to form near lower parts of the left and right first side seals can reliably be minimized.

According to the invention set forth in claim 4 in which the first shape-controlling seal portion is formed continuously with the first side seal, the liquid content can be prevented from being trapped between the first side seal and the first shape-controlling seal portion, which tends to occur when the first shape-controlling seal portion is formed independently of the first side seal.

According to the invention set forth in claim 5, the pouch body further includes a second shape-controlling seal portion formed by heat sealing the second film and the side film together at a location on an inner side of the second side seal in the left-right direction. The vicinity of the second shape-controlling seal portion of the second film is dented or caved inward of the pouch from the surrounding area. In reaction to this, the vicinity of the area below the second shape-controlling seal of the second film protrudes or bulges outward of the pouch. Utilizing this outward bulge, it is possible to minimize creation of buckle-triggering points, which tend to form near lower parts of the second side seals.

In the first film to which the spout is fixed, the outward bulging phenomenon that starts from the vicinity of the area below the first shape-controlling seal portion of the first film is stopped by the spout fixture portion where the spout is fixed and does not spread any further. In contrast, in the second film where no spout is fixed, the outward bulging phenomenon that starts from the vicinity of the area below the second shape-controlling seal portion of the second film can spread further below as compared to the first film. This allows minimization of creation of buckle-triggering points, which tend to form near lower parts of the second side seal, as well as allows the second shape-controlling seal portion to be formed at a higher position in the up-down direction than the first shape-controlling seal portion.

DESCRIPTION OF EMBODIMENTS

A spouted pouch 10 that is one embodiment of the present invention is described below with reference to the drawings.

Figure 1:
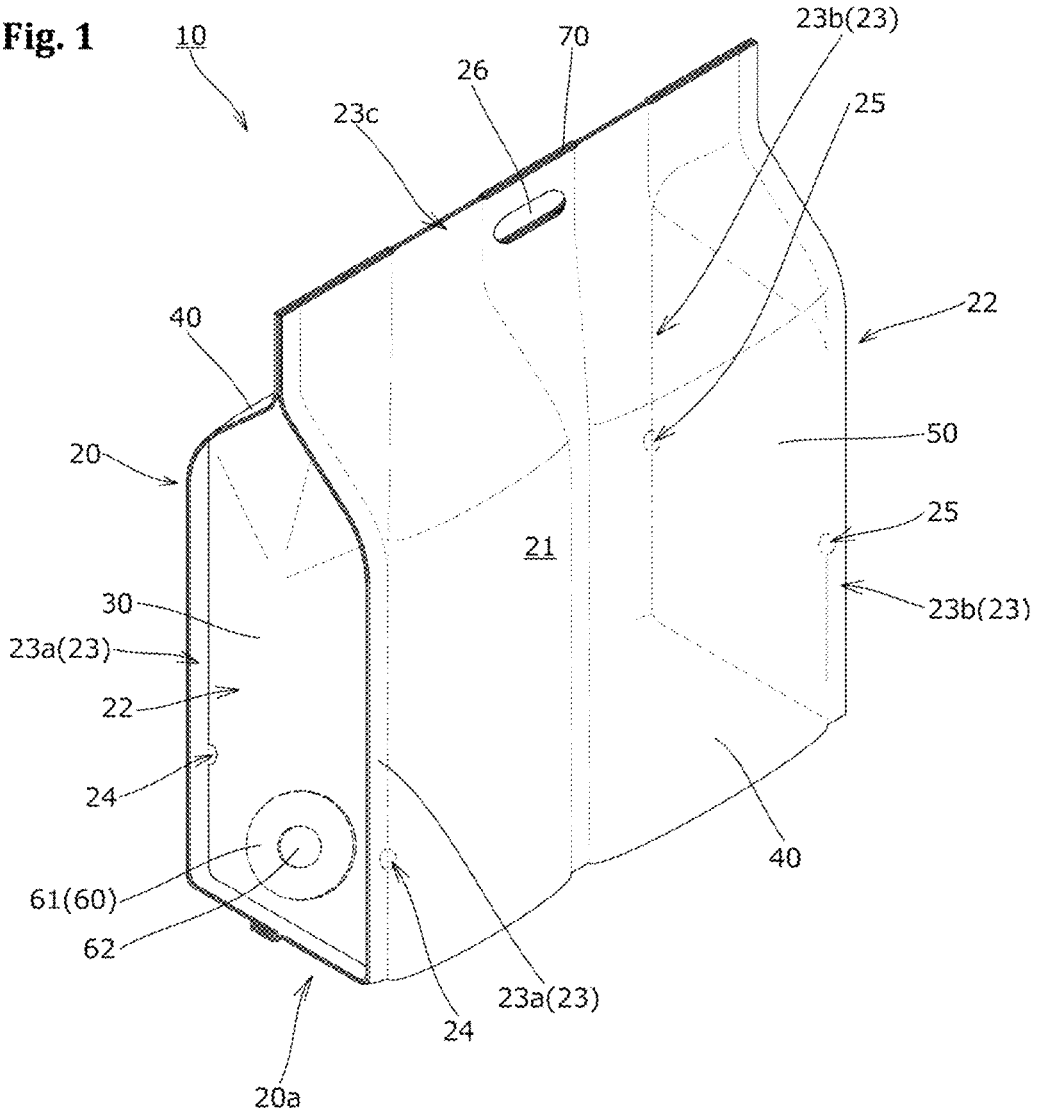
FIG. 1 is a perspective view illustrating a spouted pouch according to one embodiment of the present invention in use in a state placed on a placement surface.

The spouted pouch 10 contains a liquid content such as drinking water or liquid detergent. FIG. 1 shows a perspective view of the pouch 10 viewed from the outside. As shown in FIG. 1, the pouch is configured to dispense the liquid content from a spout 60 attached to a side face of the pouch body 20 when in use, in a state placed with the pouch bottom 20*a* down.

The spouted pouch 10 includes, as shown in FIG. 1, a pouch body 20 that is formed by flexible films 30, 40, and 50 heat-sealed along bag-making seal portions 23 into a bag shape, the spout 60 attached to the pouch body 20, and an inner film 70 disposed inside the pouch body 20. The spouted pouch 10 is accommodated inside an outer case (not shown) when in use, on display, or during transportation.

The pouch body 20 is configured as a so-called side-gusseted type pouch having a gusset 22 on both sides as shown in FIG. 1. The pouch body includes a first film 30 to which the spout 60 is attached, two side films 40 connected to the first film 30 via first side seals 23*a* formed on both left and right sides of the first film 30, and a second film 50 disposed opposite the first film 30 across a liquid content accommodating portion 21 and connected to the side films 40 via second side seals 23*b* formed on both left and right sides of the second film 50. FIG. 1 shows only a flange 61 of the spout 60.

The films 30, 40, and 50 are each formed as a rectangular (or substantially rectangular) resin film having a heat-seal layer at least on one side, and are disposed such that the heat-seal layers face each other at respective positions where they are heat-sealed together.

The films 30, 40, and 50 each have the following heat-sealed areas. The heat-sealed areas are indicated with fill patterns in the drawings such as FIG. 2.

Figure 2:
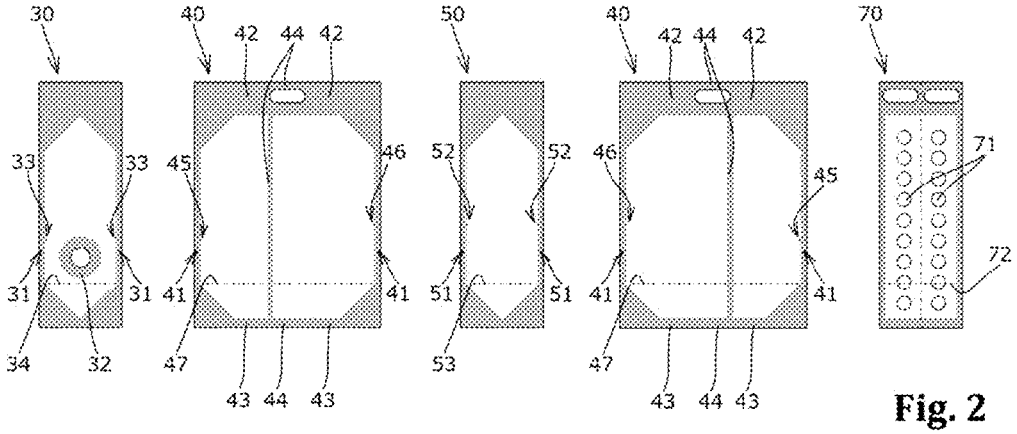
FIG. 2 is an illustrative diagram illustrating each of the films making up the spouted pouch.

First, the first film 30 includes, as shown in FIG. 2, left and right side seal heat-sealed areas 31 to be heat-sealed to the side films 40, and a spout fixture portion 32 where the spout 60 (flange 61) is fixed. In this embodiment, the flange 61 is heat-sealed to a surface of the first film 30 on the inner side of the pouch.

Each side film 40 includes, as shown in FIG. 2, side seal heat-sealed areas 41 to be heat-sealed to the first film 30 or second film 50, a top seal heat-sealed area 42 and a bottom seal heat-sealed area 43 to be heat-sealed to the other side film 40, and inner film heat-sealed areas 44 to be heat-sealed to the inner film 70.

The second film 50 includes, as shown in FIG. 2, left and right side seal heat-sealed areas 51 to be heat-sealed to the side films 40.

The first side seals 23*a* are formed by heat sealing the side seal heat-sealed areas 31 of the first film 30 and the side seal heat-sealed areas 41 of the side films 40 together. Likewise, the second side seals 23*b* are formed by heat sealing the side seal heat-sealed areas 51 of the second film 50 and the side seal heat-sealed areas 41 of the side films 40 together.

The top seal 23*c* is formed by heat sealing the top seal heat-sealed areas 42 of the side films 40 together, as well as heat sealing the inner film heat-sealed areas 44 of the side films 40 and the inner film 70 together at a position corresponding to the top of the pouch body 20. The bottom seal (not shown) is formed by heat sealing the bottom seal heat-sealed areas 43 of the side films 40 together, as well as heat sealing the inner film heat-sealed areas 44 of the side films 40 and the inner film 70 together at a position corresponding to the bottom of the pouch body 20.

The first side seals 23*a*, second side seals 23*b*, top seal 23*c*, and bottom seal (not shown) make up the bag-making seal portions 23.

Figure 3:
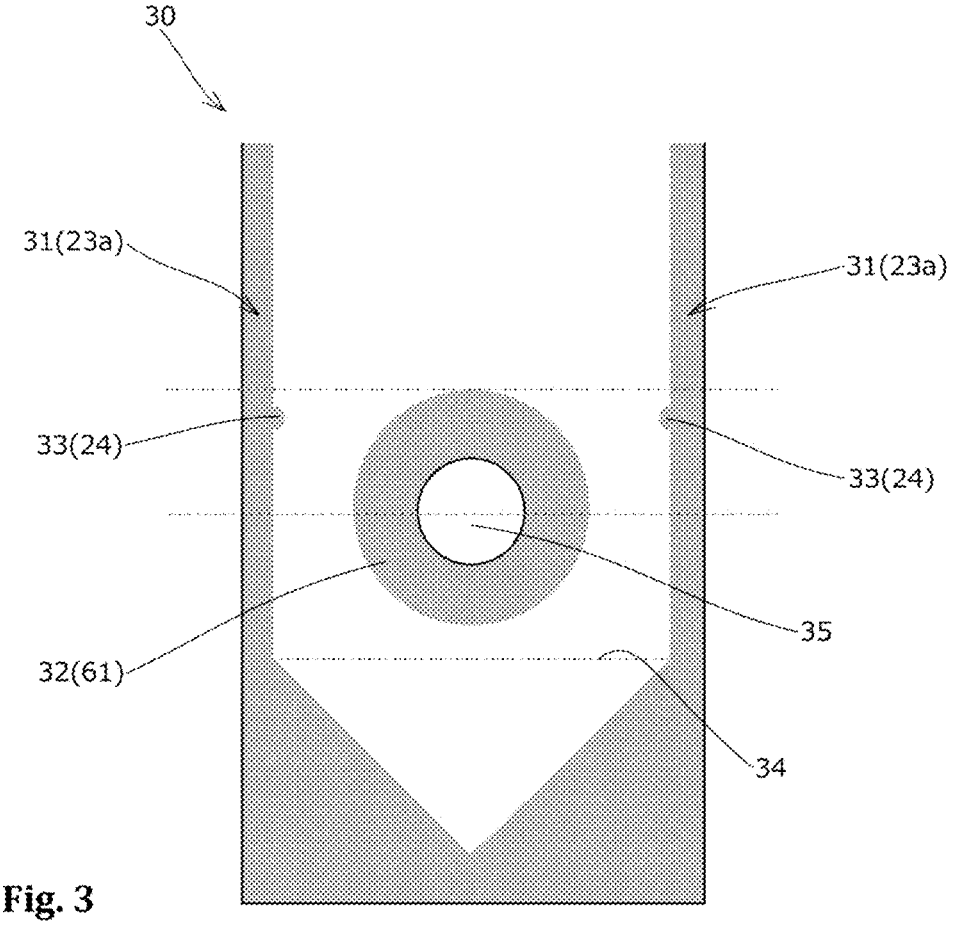
FIG. 3 is an illustrative diagram showing a first film.

The pouch body 20 further includes first shape-controlling seal portions 24 formed by heat sealing the first film 30 and the side films 40 (control seal heat-seated portions 45) together at locations (control seal heat-sealed portions 33) on the inner side of the first side seals 23*a* (side seal heat-sealed areas 31) in the left-right direction, as shown in FIG. 1 to FIG. 3.

The first shape-controlling seal portions 24 (control seal heat-sealed portions 33) are formed on both left and right sides of the spout fixture portion 32 (flange 61) such as to continuously extend inward in the left-right direction (by about 0.5 to 2.0 mm) from each first side seal 23*a* (side seal heat-sealed area 31), as shown in FIG. 1 to FIG. 3.

The first shape-controlling seal portion 24 (control seal heat-sealed portion 33) has an area located in a region between an upper half of the spout fixture portion 32 (flange 61) and the first side seals 23*a* (side seal heat-sealed areas 31) as shown in FIG. 3. In this embodiment, the entire first shape-controlling seal portions 24 (control seal heat-sealed portions 33) are located in the region between the upper half of the spout fixture portion 32 (flange 61) and the first side seals 23*a* (side seal heat-sealed areas 31).

As shown in FIG. 3, the first shape-controlling seal portions 24 (control seal heat-sealed portions 33) do not have an area located below the center in the up-down direction of the spout fixture portion 32.

Likewise, the side films 40 include control seal heat-sealed portions 45 continuously extending inward in the left-right direction from each side seal heat-sealed area 41 at positions corresponding to the control seal heat-sealed portions 33 of the first film 30 as shown in FIG. 2.

The first side seals 23*a* (side seal heat-sealed areas 31 and 41) are band-shaped along the up-down direction with inner side edges extending straight along the up-down direction as shown in FIG. 1 and FIG. 2, in the regions around the areas where the first shape-controlling seal portions 24 (control seal heat-sealed portions 33 and 45) are provided.

The pouch body 20 further includes second shape-controlling seal portions 25 formed by heat sealing the second film 50 and the side films 40 (control seal heat-sealed portions 46) together at locations (control seal heat-sealed portions 52) on the inner side of the second side seals 23*b* (side seal heat-sealed area 51) in the left-right direction, as shown in FIG. 1 and FIG. 2.

The second shape-controlling seal portion 25 (control seal heat-sealed portion 52) is formed such as to continuously extend inward in the left-right direction (by about 0.5 to 2.0 mm) from each second side seal 23*b* (side seal heat-sealed area 51), as shown in FIG. 1 and FIG. 2.

As shown in FIG. 1 and FIG. 2, the second shape-controlling seal portions 25 are formed at a higher position in the up-down direction in their entirety than the first shape-controlling seal portions 24.

In this embodiment, the distance from the pouch bottom 20*a* to the lower end of the second shape-controlling seal portions 25 is about 90 mm. The distance from the pouch bottom 20*a* to the lower end of the first shape-controlling seal portions 24 is about 60 mm.

Likewise, the side films 40 include control seal heat-sealed portions 46 continuously extending inward from the side seal heat-sealed areas 41 at positions corresponding to the control seal heat-sealed portions 52 as shown in FIG. 2.

The second side seals 23*b* (side seal heat-sealed areas 41 and 51) are band-shaped along the up-down direction with inner side edges extending straight along the up-down direction as shown in FIG. 1 and FIG. 2, in the regions around the areas where the second shape-controlling seal portions 25 (control seal heat-sealed portions 46 and 52) are provided.

The pouch body 20 has the pouch bottom 20*a*, which functions as a bottom part when the pouch body 20 is placed on a placement surface (not shown), in a state in which the spouted pouch 10 being in use is able to dispense the liquid content through the spout 60 (in a ready-to-dispense state), as shown in FIG. 1.

This pouch bottom 20*a* is formed when the spouted pouch 10 is placed on a flat placement surface (horizontal surface) and the films 30, 40, 50, and 70 are each bent by the weight of the liquid content, coming into contact with the placement surface (not shown). In this embodiment, parts of the respective films 30, 40, 50, and 70 make up the pouch bottom 20*a*. FIG. 2 illustrates the respective expected fold lines 34, 47, 53, and 72 of the films 30, 40, 50, and 70.

The spout 60 is made of a synthetic resin and serves as the outlet port when attached to the pouch body 20.

Figure 4:
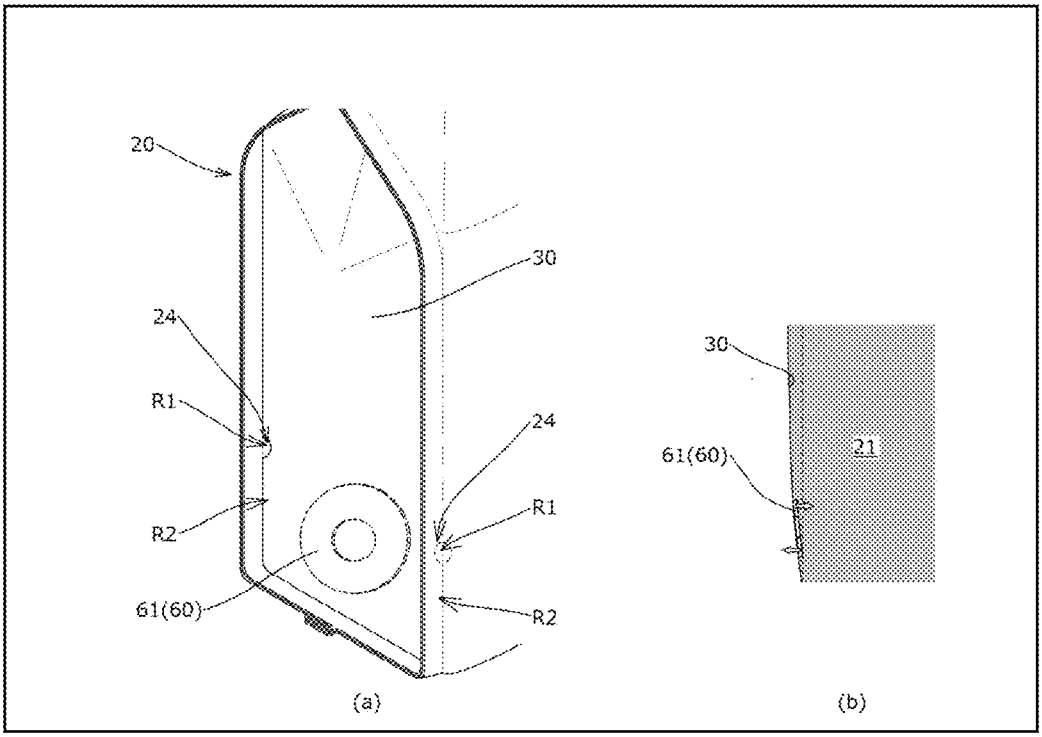
FIG. 4 is an illustrative diagram explaining the effect achieved by formation of first shape-controlling seal portions.

The spout 60 has a spout body (not shown) disposed (mostly) on the outer side of the pouch body 20, and the flange 61 as a spout fixture target portion, integrally formed to the spout body (not shown), disposed on the inner side of the pouch body 20, and fixed to an inner side face of the first film 30 by heat sealing. FIG. 4(*a*) illustrates a perspective view of the flange 61 viewed from the outside of the pouch, and FIG. 4(*b*) is a diagram of the part where the flange 61 is located as viewed from a lateral direction of the pouch. FIG. 4 shows only the flange 61 of the spout 60.

The flange 61 is formed as a disc-shaped portion with an outlet hole 62 at the center as shown in FIG. 1. The first film 30 is also formed with an outlet hole 35 at the position corresponding to the outlet hole 62 as shown in FIG. 3.

As shown in FIG. 1 and FIG. 4, the spout 60 (flange 61) is attached to a side face of the pouch body 20 at a location closer to the pouch bottom 20*a* than the center in the height direction of the pouch body (center in the longitudinal direction of the first film 30). Therefore, as shown in FIG. 4, when the first film 30 bulges out by the weight of the liquid content, the flange 61 of the spout 60 is inclined to the up-down direction such that the upper side is positioned more outward of the pouch than the lower side.

The inner film 70 is formed as a rectangular (or substantially rectangular) flexible resin film having a heat-seal layer at least on one side, and as can be seen from FIG. 1 or FIG. 2, double-folded and disposed inside the pouch body 20 (liquid content accommodating portion 21), and heat-sealed at predetermined locations to the inner film heat-sealed areas 44 of the side films 40.

The inner film 70 includes a plurality of film through holes 71 in the form of holes extending through the inner film in the thickness direction as shown in FIG. 2.

As shown in FIG. 1, a handle hole 26 is formed in the bag-making seal portion 23 at the top of the spouted pouch 10 where the films 40 and 70 overlap, opened through the portion where the films 40 and 70 overlap, for a user to put a hand or finger in to hold the spouted pouch 10.

Figure 6:
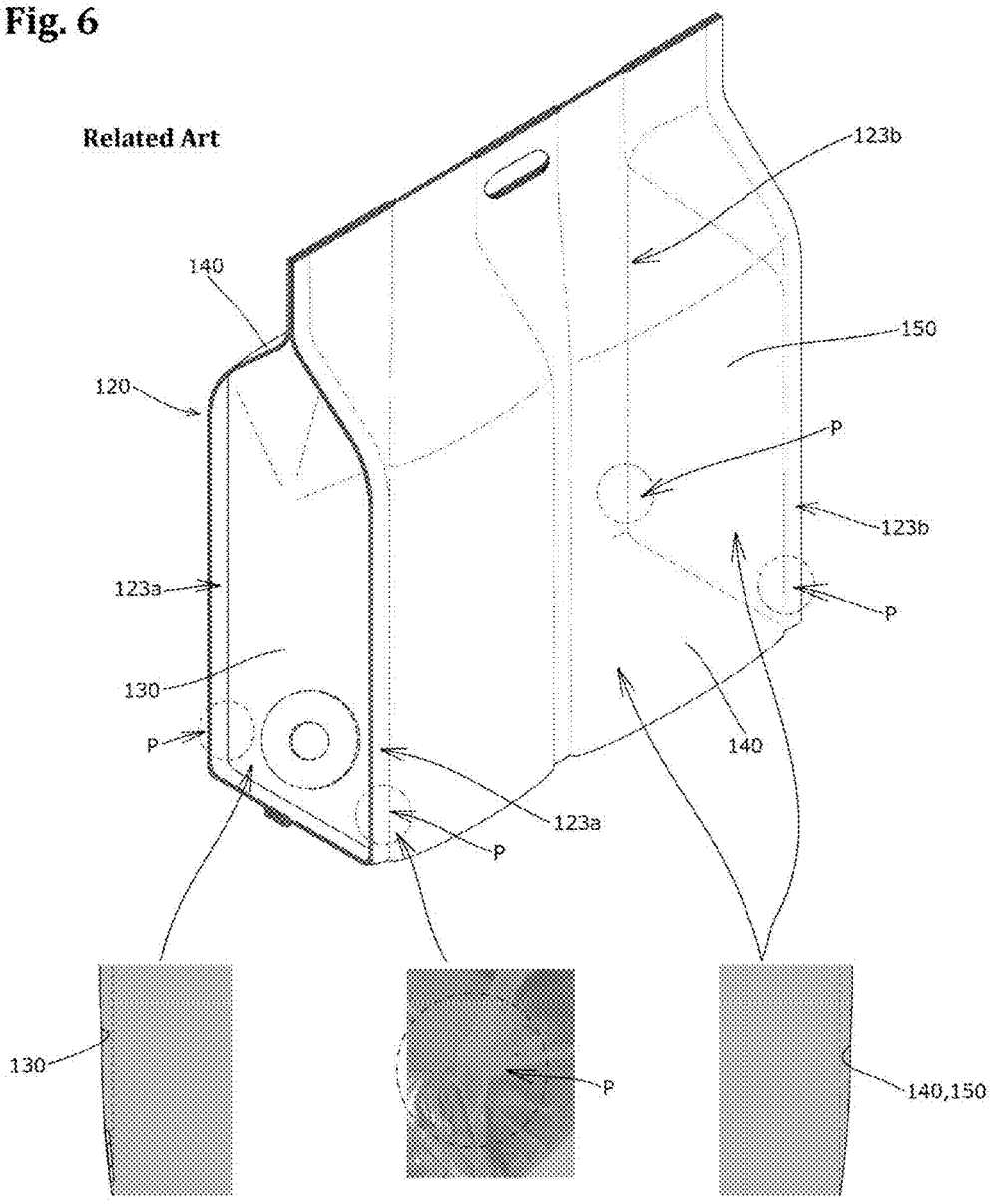
Fig. 6 Related Art
FIG. 6 is a diagram given for reference to explain a problem in a conventional spouted pouch.

The spouted pouch 10 thus obtained is formed with the first shape-controlling seal portions 24, so that the vicinities R1 of the first shape-controlling seal portions 24 of the first film 30 are dented or caved inward of the pouch from the surrounding area as shown in FIG. 4. In reaction to this, the vicinities R2 of the areas below the first shape-controlling seal portions 24 of the first film 30 protrude or bulge outward of the pouch (the first film 30 becomes tense in these areas). Utilizing this tension, it is possible to adjust the inclination of the flange (spout fixture target portion) 61 such as to shift the upper side of the flange (spout fixture target portion) 61 fixed to the first film 30 inward of the pouch and to shift the lower side of the flange (spout fixture target portion) 61 outward of the pouch. This adjustment of the inclination of the flange (spout fixture target portion) 61 can be used to shift the first film 30 outward in the area beneath the flange (spout fixture target portion) 61 to minimize creation of buckle-triggering points P, which tend to form in lower parts of the first side seals 23*a* (side seal heat-sealed areas 31), as shown in FIG. 6, which leads to a better self-standing ability of the spouted pouch 10.

While one embodiment of the present invention has been described above in detail, the present invention is not limited to the above-described embodiment and may be carried out with various design changes without departing from the scope of the present invention set forth in the claims. Various features of the above-described embodiment and variation examples to be described below may be combined as desired to configure another spouted pouch 10.

For example, while the spouted pouch 10 is accommodated inside an outer case (not shown) when in use, on display, or during transportation in the above-described embodiment, the spouted pouch 10 need not necessarily be accommodated inside an outer case (not shown) and may be used, or displayed, or transported as it is.

The films 30, 40, 50, and 70 may each have any specific form as long as the films include a layer having heat sealability at least on one side, which may be composed of olefins such as low-density polyethylene or polypropylene, or polyesters such as PET (polyethylene terephthalate); they may either have a single heat-seal layer, or any other layers laminated on the heat-seal layer. Any materials may be used to form the laminates. Any known polyesters such as PET or PBT (polybutylene terephthalate), polypropylene, polyamide, polyethylene, aluminum foil, and so on, may be laminated in any manner.

While the pouch body 20 is formed from four films 30, 40, and 50 in the above-described embodiment, the specifics of the pouch body 20 configuration such as the number of films etc., are not limited to the above-described embodiment.

The inner film 70 may not be provided.

While the first film 30 with the spout 60 attached thereto (or second film 50) is a gusset-forming film in the above-described embodiment, the first film 30 (or second film 50) need not necessarily be a gusset-forming film.

Figure 5:
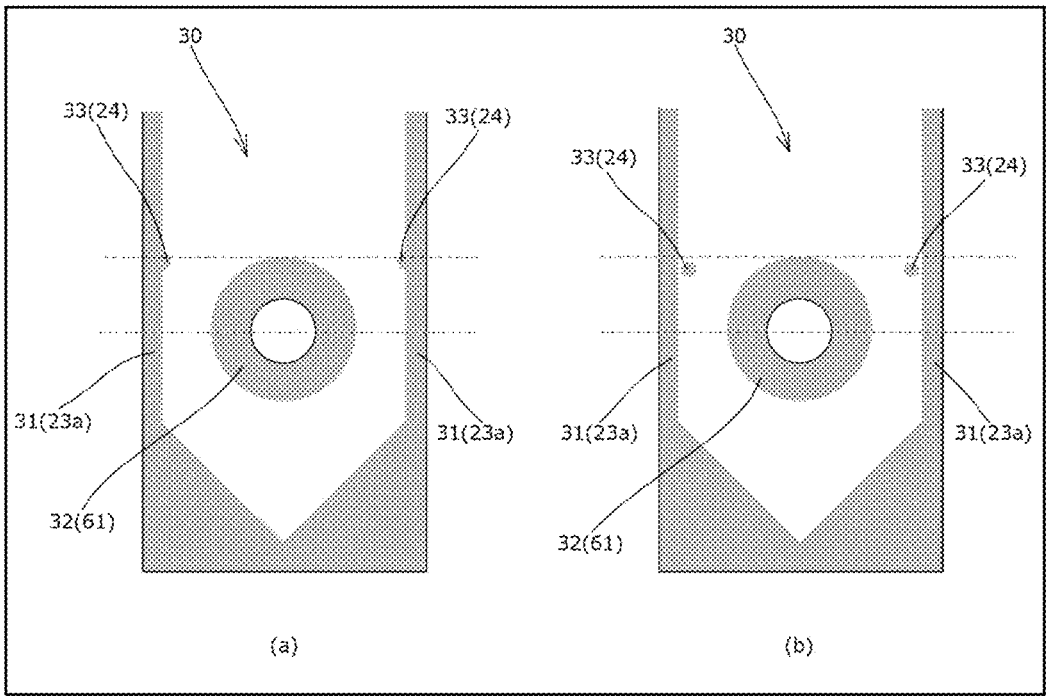
FIG. 5 is an illustrative diagram showing a variation example of the position of the control seal heat-seated portions.

In this embodiment, the entire first shape-controlling seal portions 24 (control seal heat-sealed portions 33) are located in a region between an upper half of the spout fixture portion 32 (flange 61) and the first side seals 23*a* (side seal heat-sealed areas 31). Instead, as shown in FIG. 5(*a*), the first shape-controlling seal portions 24 may be formed such as to be partly located in the region between the upper half of the spout fixture portion 32 (flange 61) and the first side seals 23*a* (side seal heat-sealed areas 31). In the case shown in FIG. 5(*a*), too, it is preferable that parts of the first shape-controlling seal portions 24 (control seal heat-sealed portions 33) closest to the center in the left-right direction of the first film 30 are located in the region between the upper half of the spout fixture portion 32 (flange 61) and the first side seals 23*a* (side seal heat-sealed areas 31).

In the above-described embodiment, the first shape-controlling seal portions 24 (control seal heat-sealed portions 33 and 45) are formed continuously with the first side seals 23*a* (side seal heat-sealed areas 31 and 41). Instead, as shown in FIG. 5(*b*), the first shape-controlling seal portions 24 (control seal heat-sealed portions 33 and 45) may be formed independently of (at positions away from) the first side seals 23*a* (side seal heat-sealed areas 31 and 41). Similarly, the second shape-controlling seal portions 25 (control seal heat-sealed portions 46 and 52) may be formed independently of (at positions away from) the second side seals 23*b* (side seal heat-sealed areas 41 and 51).

In the above-described embodiment, one each first shape-controlling seal portion 24 is formed on both left and right sides of the spout fixture portion 32. Instead, the first shape-controlling seal portion 24 may be formed on one of the left and right sides of the spout fixture portion 32. In other words, while two first shape-controlling seal portion 24 are formed in the above-described embodiment, there may be only one first shape-controlling seal portion 24. Similarly, there may be only one second shape-controlling seal portion 25 instead of two.

In the above-described embodiment, the flange 61 is formed in the shape of a disc with an outlet hole 62 at the center. The flange 61 may have any other specific shapes such as a rectangular or polygonal shape, with the outlet hole 62 formed at the center.

While the spout fixture target portion 61 heat-sealed to the pouch body 20 is the flange 61 of the spout 60 in the above-described embodiment, the spout fixture target portion 61 need not be the flange 61. In other words, other parts of the spout 60 than the flange 61 may be fixed to the pouch body 20.

While the flange 61 as the spout fixture target portion 61 is fixed to an inner side face of the first film 30 in the above-described embodiment, the flange 61 may be fixed to an outer side face of the first film 30.

The flange 61 as the spout fixture target portion may be fixed to the first film 30 by any other means than heat sealing such as bonding.

The terms used herein indicating vertical directions such as "top," "bottom," "side," and so on are not intended to limit the orientation of the spouted pouch 10 set on display or during transportation. For example, the spouted pouch 10 may be set on a placement surface with a side or top of the spouted pouch 10 down.

REFERENCE SIGNS LIST

10 Spouted pouch
20 Pouch body
20*a* Pouch bottom
21 Liquid content accommodating portion
22 Gusset
23 Bag-making seal portion
23*a* First side seal
23*b* Second side seal
23*c* Top seal
24 First shape-controlling seal portion
25 Second shape-controlling seal portion
26 Handle hole
30 First film
31 Side seal heat-sealed area
32 Spout fixture portion
33 Control seal heat-seated portion
34 Expected fold line
35 Outlet hole
40 Side film
41 Side seal heat-sealed area
42 Top seal heat-sealed area
43 Bottom seal heat-sealed area
44 Inner seal heat-sealed area
45 Control seal heat-seated portion
46 Control seal heat-seated portion
47 Expected fold line
50 Second film
51 Side seal heat-sealed area
52 Control seal heat-seated portion
53 Expected fold line
60 Spout
61 Flange (spout fixture target portion)
62 Outlet hole
70 Inner film
71 Film through hole
72 Expected fold line

The invention claimed is:

1. A spouted pouch configured to dispense a liquid content from a spout attached to a side face of a pouch body in a state placed with a pouch bottom down, the pouch body including a first film having a spout fixture portion to which a spout fixture target portion of the spout is fixed, and side films connected to the first film via first side seals formed on both left and right sides of the first film, the pouch body further including a first shape-controlling seal portion formed by heat sealing the first film and the side film together at a location on an inner side of the first side seal in a left-right direction, wherein the pouch body includes a top seal portion and a main portion disposed below the top seal portion and configured by four side surfaces including a first side surface, the first side surface formed by the first film and comprising an inclined side surface and a substantially vertical side surface in a state in which the spouted pouch is placed with the pouch bottom down and with containing a liquid content therein, wherein the four side surfaces are laminated together in the top seal portion, wherein the inclined side surface extends continuously from the top seal portion, wherein the substantially vertical side surface is located below the inclined side surface and extends continuously from the inclined side surface, wherein the first shape-controlling seal portion is disposed to the substantially vertical side surface, wherein the spout fixture portion is disposed to the substantially vertical side surface, the first shape-controlling seal portion having an area located in a region between an upper half of the spout fixture portion and the first side seals, and not having an area located below a center in an up-down direction of the spout fixture portion such that a vicinity of the first shape-controlling seal portion of the first film in the substantially vertical side surface is dented inward of the pouch from a surrounding area thereof and a vicinity of an area below the first shape-controlling seal of the first film in the substantially vertical side surface protrudes outward of the pouch to adjust an inclination of the spout fixture target portion so as to shift an upper side of the spout fixture target portion inward of the pouch and to shift a lower side of the spout fixture target portion outward of the pouch.

2. The spouted pouch according to claim 1, wherein part of the first shape-controlling seal portion closest to a center in the left-right direction of the first film is located in the region between the upper half of the spout fixture portion and the first side seals.

3. The spouted pouch according to claim 1, wherein the first shape-controlling seal portion is formed on each of left and right sides of the spout fixture portion.

4. The spouted pouch according to claim 1, wherein the first shape-controlling seal portion is formed continuously with the first side seal.

5. The spouted pouch according to claim 1, wherein the pouch body includes a second film disposed opposite the first film across a liquid content accommodating portion, the second film being connected to the side films via second side seals formed on both left and right sides of the second film, the pouch body further including a second shape-controlling seal portion formed by heat sealing the second film and the side film together at a location on an inner side of the second side seal in the left-right direction, the second shape-controlling seal portion being formed at a higher position in an up-down direction than the first shape-controlling seal portion.

* * * * *